United States Patent [19]

Meyer

[11] 3,974,738

[45] Aug. 17, 1976

[54] ROTARY DIFFERENTIAL AMMUNITION RESERVOIR

[75] Inventor: Elwyn A. Meyer, Granite City, Ill.

[73] Assignee: Emerson Electric Co., St. Louis, Mo.

[22] Filed: Aug. 9, 1974

[21] Appl. No.: 496,280

[52] U.S. Cl. ..... 89/34

[51] Int. Cl.[2] ..... F41D 9/02

[58] Field of Search ..... 89/33 R, 33 D, 33 B, 89/33 BA, 33 BB, 33 BC, 33 E, 34; 206/3

[56] References Cited

UNITED STATES PATENTS

| | | | |
|---|---|---|---|
| 2,756,638 | 7/1956 | Maillard | 89/33 CA |
| 3,687,004 | 8/1972 | Faisandier | 89/33 D |

FOREIGN PATENTS OR APPLICATIONS

| | | | |
|---|---|---|---|
| 933,264 | 4/1948 | France | 89/33 BA |
| 558,949 | 1/1944 | United Kingdom | 89/33 E |

*Primary Examiner*—Stephen C. Bentley
*Attorney, Agent, or Firm*—Polster and Polster

[57] ABSTRACT

A rapid-fire weapon system having an associated magazine for storing individual rounds and a carrier system for transferring rounds from the magazine to the firing chamber of the weapon is provided with intermediate correlating means for matching the output rate of the magazine with the input rate of the weapon. In the preferred embodiment, the correlating means includes a housing having a movable part and a stationary part. The carrier system from the magazine is operatively connected to the stationary housing part. The movable housing part is rotatable with the weapon in an azimuth plane. The correlating means has storage means associated with it and differential means for meeting the demand rate of the weapon, which corresponds to the output rate of the device, with any output rate from the magazine, which corresponds to the input rate for the device.

18 Claims, 7 Drawing Figures

ROTARY DIFFERENTIAL AMMUNITION RESERVOIR

BACKGROUND OF THE INVENTION

This invention relates to weapon systems and in particular to apparatus for feeding either linked or linkless rounds to a rapid-fire weapon. While the invention is described in particular detail with respect to the linkless ammunition in a rapid-fire weapon system, those skilled in the art will recognize the wide applicability of the principles disclosed hereinafter.

Rapid-fire weapon systems, particularly when installed in an air-borne carrier, present heretofore unresolved problems in their operation. In general, the firing weapon of an air-borne carrier is contained in a gun mount or turret located at one part of either a fixed or rotary wing aircraft, and the magazine supply for ammunition rounds is located some distance from the gun mount in another part of the aircraft. Mere separation of the weapon and magazine is troublesome. For example, the length of the supply line between the magazine and the weapon can be so great that the pulling force of the weapon may be insufficient to draw the rounds from the magazine container due to the conveyor length, and, hence, the weight of the conveyor along the supply path.

The prior art does deal with the conveyor length problem and offers a number of problem solutions. In general, the prior art provides means for driving either the magazine or the conveyor at a rate comparable to the weapon demand rate. While these prior art solutions work for their intended purposes, the solution themselves often raise additional difficulties. Thus, high power is required to overcome the inertia of the magazine when the magazine is driven in conjunction with the demand rate of the weapon. Since the firing weapon demand rate varies between instantaneously high and instantaneously low, depending on whether the firing mechanism is held on or released, rather complex systems are needed to bring the mazazine first to a high feed rate and then to bring it to rest after the gun shuts down. Magazine drive is further complicated when the weapon is fired in short but repeated bursts. Extremely complex devices are required for drive control under these conditions. If the magazine itself is not drivable, some form of powerdriven sprocket is utilized in conjunction with a stationary magazine to accomplish the same purpose. Although a power driven sprocket requires less driving power, it requires the same type of complex control devices. Other weapon system designs rely merely on the pull of the gun to move the rounds to the firing chamber.

While prior art solutions to the problem of feeding a rapid-fire gun are acceptable in certain application installations, their use with a rapid-fire weapon movable in elevation and azimuth planes, for example, particularly where the system is installed in an air borne carrier, has presented additional unresolved difficulties. In air borne weapon applications, individual rounds from the magazine are transported to the gun mount by some type of conveyor or other rounds carrier, usually contained within a flexible chute. These flexible chutes commonly are capable of motion in both elevation and azimuth planes. The chute contortions dictated by required elevation and azimuth angles for proper gun mount flexibility result in ever changing dynamic conditions in the ammunition, chutes and conveyors. This in turn has resulted in increased weapon reliability problems, because flexible chutes have a number of inherent deficiencies. For example, friction between the conveyor or the ammunition proper and the feed chute can vary as the chute twists and rolls or expands and contracts in following the motion of the weapon. Consequently, the force required to either drive or pull the ammunition varies, and changes the power requirements for the drive mechanism. Because of the motion of the weapon necessarily acts on the flexible chute utilized, the chute may collapse or extend axially during weapon motion. Compression or extension causes the ammunition flow path to change its dimensional length, which generally leads to a compressive or tension force being applied to the conveyance means or the ammunition. Compression or tension forces on the chute leads to dimensional changes in the chute which in turn causes a velocity change for the ammunition within the feed chute. Compression and tension forces on the chute, in addition to increasing the friction between the ammunization and chute, also can cause separation of either the ammunition conveyance means or the chute itself.

Most prior art weapon systems utilize a common power source both to power the weapon's storage magazine and to power the associated feed system components in order to match the velocity and acceleration requirements of the firing weapon. Commonly, use of a common power source leads to utilization of oversized power devices in order to meet all system contingencies and complex control means for regulating the power source. This combination of factors leads to increased weight, inertia, complexity and expense of the weapons system.

The invention disclosed hereinafter overcomes these prior art deficiencies with a novel device or mechanism that has a fixed, non-flexible chute connected between the input side of the device and the output of the magazine. The fixed, non-flexible chute and associated conveyor brings individual rounds from a conventional storage magazine to the entrance of the device. The device has its entrance anchored to a fixed structure. The output end of the device, however, is designed to rotate with the weapon or weapon mount. While a flexible chute still is connected between the output side of the device and the firing weapon, that chute need be movable only in the elevation plane of the weapon. Three power inputs are used in connection with the invention. One input from the weapons's magazine correlates the input to the mechanism with the magazine feed rate. The exit power from the device is obtained from the weapon's demand. The third input is obtained from weapon mount rotation. Weapon mount rotation is used to adjust rounds within the device. This precludes the necessity of changing round position in either the fixed chute connected between the mechanism input and the magazine output or in the flexible chute connected between the output of the mechanism and the weapon.

The mechanism includes storage means and a differential for transferring rounds in the storage means. The differential adds and subtracts velocities to match the input velocity to the mechanism and the output velocity from the mechanism to the required weapon feed rate. By utilizing the storage capacity within the device, it is possible to permit the weapon to fire at full rate without requiring the magazine to match this rate in phase with the weapon. Consequently, reduced power is required to accelerate the magazine upon initiation of weapon operation. The elimination of chute motion about the azimuth plane permits the use of a fixed or rigid type feed chute for substantially the entire chute length, which in turn reduces cost in the overall system and provides increased reliability by elimination of potential jam or high friction points inherent in flexible chuting, caused by chute motion. The system described hereinafter also will allow the gun to cease fire while the reservoir provided in the mechanism absorbs ammunition and refills to a correct level before requiring the magazine to halt. This action again may be accomplished out of phase from the weapon.

One of the objects of this invention is to provide a simplified weapon system for a rapid firing weapon.

Another object of this invention is to provice means for correlating a rapid fire weapon demand rate for ammunition and the output rate of an associated magazine.

Another object of this invention is to provide a correlating device utilizing differential means for adjusting input and output velocities from the device.

Yet another object of this invention is to provide a correlating means mounted to and rotatable with a gun turret.

Yet another object of this invention is to provide a weapon system for a rapid fire gun having reduced power requirements for the drive of an associated magazine.

Other objects will be apparent to those skilled in the art in light of the following description and accompanying drawings.

SUMMARY OF THE INVENTION

In accordance with this invention, generally stated, a rapid fire weapon system is provided with intermediate correlating means for matching the output rate of the magazine with the input rate of the weapon. The correlating means includes a housing having a first fixed part, a second rotatable part, and a rounds reservoir interleafed above and below a differential means for summing magazine output and weapon input rates. The combination of reservoir and differential enables the correlating means to meet gun demand simultaneously, in phase, and to treat azimuth rotation of the weapon mounting merely as one factor in differential position. Because the correlating means eliminates azimuth motion in the ammunition feed system, the conveyor and chute utilized in conjunction with the weapon also in less complex, and lower in both cost and weight.

BREIF DESCRIPTION OF THE DRAWINGS

In the drawings, FIG. 1 is a diagrammatic view in perspective, partly broken away, of a weapon system utilizing one illustrative embodiment of rotary differential ammunition reservoir of this invention;

DESCRIPTION OF THE PREFERRED EMBODIMENT

Figure 1:
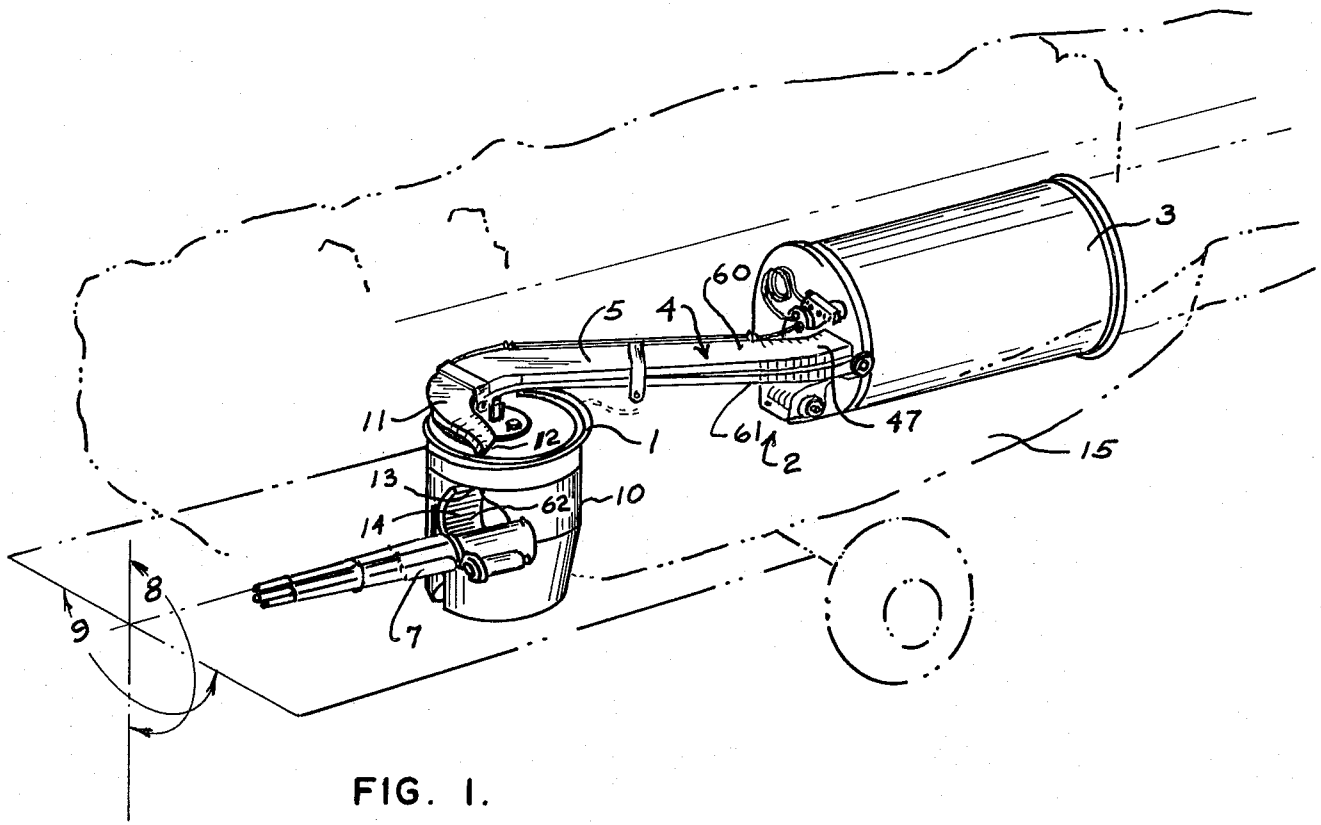

Referring now to FIG. 1, reference numeral 1 indicates the rotary differential ammunition reservoir of this invention illustratively shown as forming a part of a weapon system 2. The weapon system 2 includes a storage magazine 3 having an output side connected to a conveyance means 4. The conveyance means 4 includes a chute 5 covering a conventional ammunition conveyor 6, shown in FIG. 2. The conveyor 6 is an endless loop type having a forward path 60 and a return path 61. As used hereinafter, the terms conveyance means 4 and chute 5 are intended to encompass both of the paths 60 and 61.

A rapid fire weapon 7 is mounted in a gun turret 10 for movement in an elevation plane 8 and in an azimuth plane 9. The weapon 7 and gun turret 10 are conventional and a variety of rapid fire weapons and their associated gun turrets are compatible with the broader aspects of this invention.

The reservoir 1 is mounted to the turret 10 by any convenient method. As is explained in detail hereinafter, a portion of the reservoir 1 is rotatable with the turret 10 in the azimuth plane 9. A partially flexible end 11 terminates one side of the conveyance means 4. A second end 47 of the conveyance means 4 also is partially flexible. The flexible ends 11 and 47 are desirable in order to permit easy reloading of the magazine 3, and to provide easy connect and disconnect functions between the conveyance means 4 and the reservoir 1 or the magazine 3 should any malfunction occur in those portions of the system 2. However, once in position, the ends 11 and 47 of the conveyance means 4 function as fixed elements in the operation of the system 2.

The reservoir 1 has an input side 12 and an output side 13. The output side 13 is connected to the input of the weapon 7 by a conveyance means 14. Conveyance means 14 includes a chute 62 covering a conventional conveyor, not shown, which also commonly has a forward and a return path arranged in an endless loop, similar to conveyance means 4. The chute 62 also is flexible in the sense of the flexible ends 11 and 47 of conveyance means 4. That is, the conveyance means 14 need be movable with the weapon 17 only in one plane, the elevation plane 8, as it may rotate in the azimuth plane 9 with the weapon 7 and a portion of the reservoir 1. The conveyance means 14, besides being relatively short in overall length, is more simple in construction and lower in cost than flexible chutes movable in two planes commonly used in prior art devices.

The weapon system 2 may be installed on any convenient launch platform 15. Launch platform 15 is illustrated in phantom lines as an aircraft structure, of either a rotary or a fixed wing type. The magazine 3 is placed at any convenient location on the launch platform 15 and the conveyance means 4, a substantial part of which is constructed from a non-flexible chute material, is interconnected between the magazine and the input 12 to the reservoir 1. Because the major portion of the conveyance means 4 is a non-flexible chute and the entire length of the conveyance means 4 operates as a non-flexible chute, problems inherent in prior art systems related to chute dynamics are eliminated and the weapon system 1 exhibits high reliability with little down time because of ammunition jams or chute separations.

Figure 2:
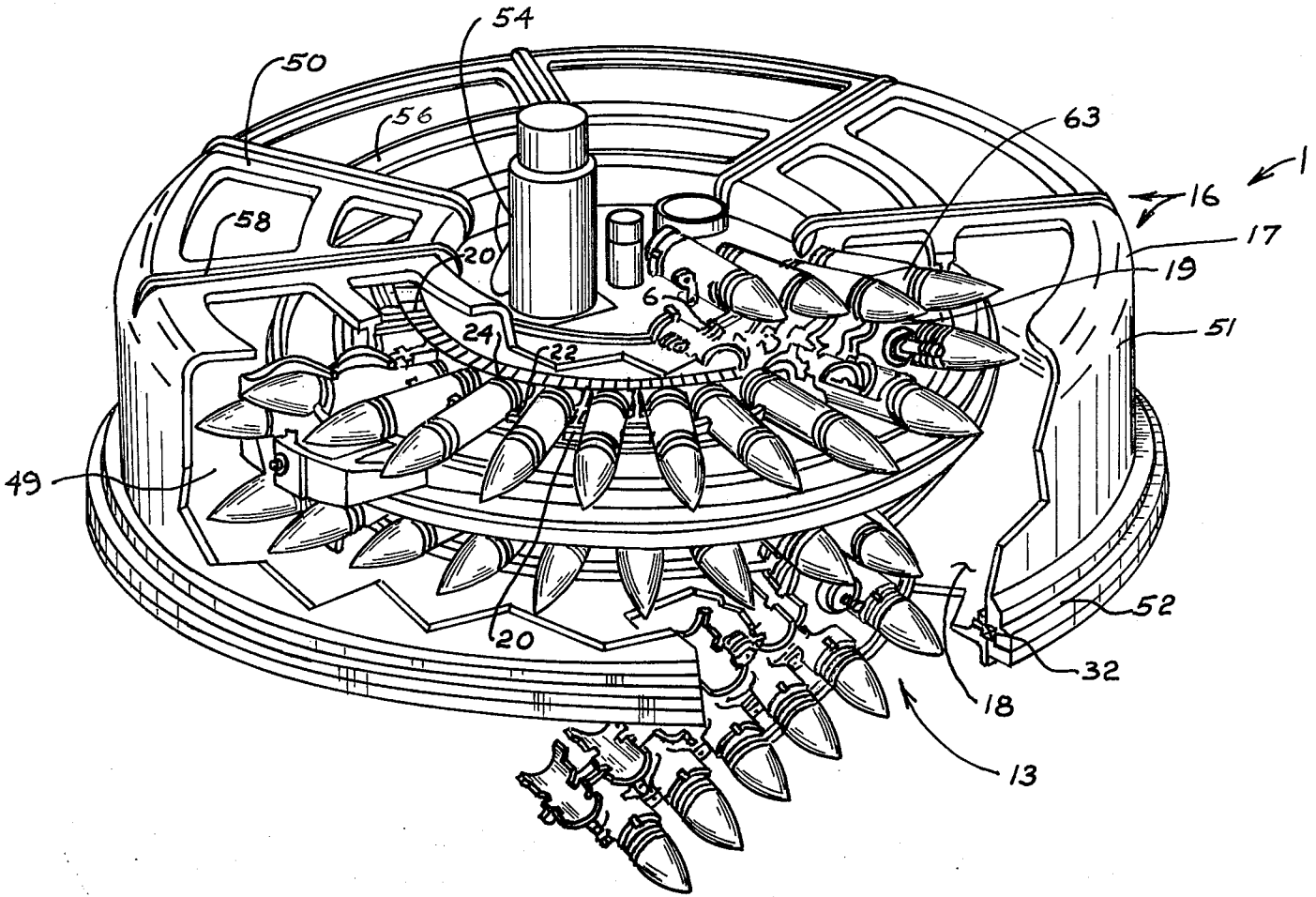
FIG. 2 is a view of perspective, partly broken away, of a second illustrative embodiment of a rotary differential ammunition reservoir compatible with the weapon system of FIG. 1.
Figure 7:
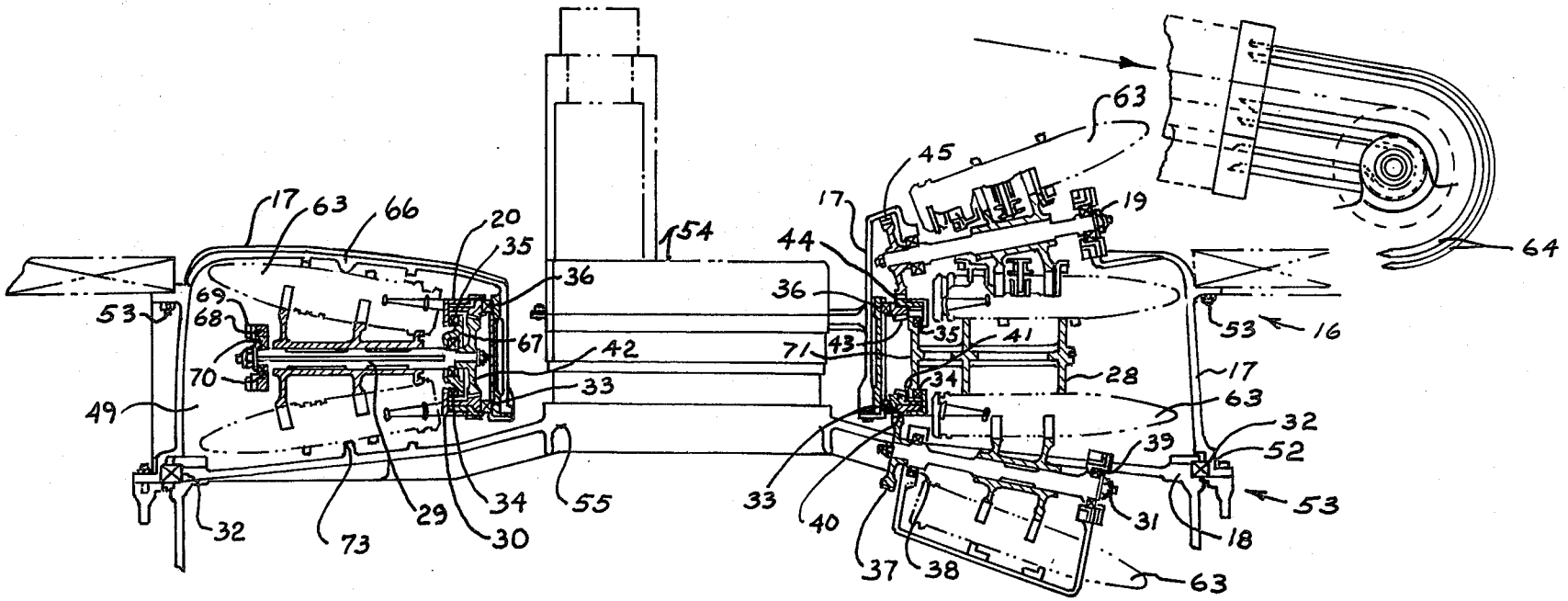
FIG. 7 is a sectional view taken along the line 7—7 of FIG. 6.

Referring now more specifically to FIGS. 2 and 7, the reservoir 1 includes a housing 16 having a first or upper stationary housing part 17 and a lower rotatably mounted plate 18, which define a chamber 49 in their intermounted position.

The stationary part 17 includes a top wall 50 and an integrally formed, downwardly extending side wall 51. The lower extremity of the side wall 51 has a flange 52 extending radially outwardly from it. The flange 52 seats a bearing means 32 which permits rotation of the plate 18 with respect to the part 17. The part 17 is attached to convenient stationary structure as illustratively shown at 53. Attachment may be made by conventional threaded fasteners, for example. Top wall 50 has a central hub area 54 which, together with a similar hub 55 in the plate 18, provide passage for various conventional gun turret 10 power drives and related components which form no part of this invention and are not described in detail. The top wall 50 preferably is a lattice structure having a plurality of radial spokes 58 extending outwardly from the hub area 54 to the side wall 51 and a series of annular ribs 56 supportively attached to the spokes 58. The reservoir 1 shown in FIGS. 1 and 2 are identical with the exception of the lattice construction of the stationary part 17. The lattice design gives better access and visibility to the internal components of the reservoir 1 and is preferred for this reason. An input sprocket 19 is rotatably mounted to the stationary housing part 17.

The input sprocket 19 shown is a six station, two wheel device of conic design. The sprocket 19 is designed to provide smooth transfer of an individual round 63 from the conveyance means 4 to the reservoir 1. A plurality of scoop cams 64 may be utilized as an aid in round transfer.

Individual rounds 63 are transferred from the storage magazine 3 to the conveyance means 4 which in turn transports the rounds 63 to the upper housing part 17 of the reservoir 1. Since the upper housing part 17 is attached to a fixed structure and is itself not movable, the chute 5 which guides the conveyor 6 can be of rigid type construction. It should be reiterated that this feature of fixed chuting greatly enhances the reliability of the feed system. Simply stated, fixed chuting represents a constant conveyor length and subsequently constant tension on the conveyor loop. Experience has shown that reliability and power requirements of a weapon supply system are extremely sensitive to changes in conveyor tension. A slack conveyor means a change in linear pitch, i.e., links folding, and therefore a loss of positive control of the conveyor loop. On the other hand, a tight conveyor requires more power due to resultant high friction loads between the conveyor and the chuting.

The conveyor 6 of the conveyance means 4 approaches the input sprocket 19 of the reservoir 1 in a plane tangent to the line of revolution which forms the conic of the sprocket 19. The conveyor plane also is curved toward the apex of the sprocket 19 cone to match velocities at the tangency plane. It should be noted that the round/conveyor spacing at the pull line of the conveyor 6 remains constant and differences in the linear velocity between the nose and butt of an individual round 63 is achieved by canting the conveyance means 4 about a point on the conveyor pull line. The phrase "pull line" is a term of art and refers to the longitudinal axis of the ammunition conveyor. Achieving this geometry to the tangency line with the sprocket is accomplished by simply curving the cute end 11 as shown in FIG. 1. Individual ones of the rounds 63 are transported by the sprocket 19 from the conveyance means 4 through the stationary housing part 17, to an upper transfer wheel 20.

The upper transfer wheel 20 generally is a flat, annular plate having a plurality of tangs 22 which engage individual ones of the rounds 63 along an extractor groove 24 in the rounds. The tangs 22 are formed integrally with a plurality of fingers 25 which extend radially outwardly from a central hub 26 of the upper transfer wheel 20. Lateral control of the rounds 63 within the reservoir 1 is maintained by a pair of concentric rings 65 formed on each side of a differential rounds carrier 28 and a ring 66 which is integrally formed with the stationary housing part 17. These rings combine to provide a stable, three point support of the round.

The differential rounds carrier 28 is annular in plan and includes an outer and inner rim 67 and 68 which have the rings 65 integrally formed therewith. The rims 67 and 68 are journaled for rotation with respect to an outer support structure 69 along bearing means 70 and with respect to an inner support structure 71 along a bearing means 72. A transfer sprocket 29 is mounted to the differential rounds carrier 28 between the rims 67 and 68 and is rotatable with respect to the carrier 28. The rings 65, which as previously indicated, are integrally formed with the rounds carrier 28, enable the rounds 63 to be canted as they approach the transfer sprocket 29. Canting the rounds 63 allows a smooth transition of the rounds from the upper transfer wheel through the differential rounds carrier to the lower transfer wheel, minimizing the acceleration of the round during transition. The differential rounds carrier 28 is symmetrical in a horizontal plane. That is, the round is canted as it approaches the transfer sprocket 29 and is straightened as it travels away from the sprocket on the opposite, lower side of the rounds carrier 28. As is later explained, the reservoir 1 is symmetrical about and below the differential rounds carrier 28 and the same guidance control features apply to the lower half of the reservoir 1.

Mounted beneath the differential rounds carrier is a lower transfer wheel 30. The lower transfer wheel 30 is similar to the upper transfer wheel 28 and includes the central hub 26 having a plurality of the fingers 25 extending radially outwardly from it. The upper and lower transfer wheels are identical and may be interchanged with one another during the manufacture of the reservoir 1. The lower transfer wheel 30 receives the rounds 63 from the transfer sprocket 29 and carries them to an output sprocket 31. Output sprocket 31 is mounted to the lower rotatably mounted plate 18 and is rotatable both with and with respect to plate 18. The plate 18 includes a ring 73 for supporting the rounds 63. While preferably described as a distinct part, those skilled in the art will recognize that the plate 18 may in fact comprise the top wall of the gun turret 10, if desired.

The sprocket 31, like the sprocket 19, is a six station, two wheel device of conic design. The conveyance means 14 also is curved toward the apex of the sprocket 31 to match velocities at the tangency plane.

Again, this geometry is achieved merely by curving the conveyance means 14 as shown in FIG. 1.

To recapitulate the functional operation of the reservoir 1 in its simplest terms, rounds 63 are transported from the magazine 3 via the conveyance means 4 to the input sprocket 19 of the reservoir 1. The rounds are transferred from the conveyor to the upper transfer wheel 20 which serves as one half of the reservoir for the rounds 63. The rounds 63 in turn are transferred from the upper transfer wheel 20 to the lower transfer wheel 30 by the transfer sprocket 29 of the differential rounds carrier 28. The lower transfer wheel 30 transfer the rounds 63 to the output sprocket 31 of the reservoir 1 at which point the rounds are placed into the gun conveyance means 14 for transport to the rapid fire weapon 7.

To achieve this operation, the lower plate 18 is rotatably mounted with respect to the stationary housing part 17 along the bearing means 32. The lower transfer wheel 30 is rotatably mounted with respect to the plate 18 along a bearing means 33. Transfer wheel 30 also is rotatably mounted with respect to the differential rounds carrier 28 along a bearing means 34. The differential rounds carrier 28 in turn is rotatably mounted with respect to the upper transfer wheel 20 along a bearing means 35. Finally, the upper transfer wheel 20 is rotatably mounted with respect to the stationary housing part 17 along a bearing means 36.

A system of internal gears is utilized in conjunction wth the upper transfer wheel 20, the lower transfer wheel 30 and the differential rounds carrier 28 to enable the reservoir 1 to correlate weapon demand rate with magazine output rate. The reservoir 1 gear system may be considered a rack and pinion differential in which the racks used are infinitely long, i.e., are plantary gears. Basically, a differential device is simply an adding machine that can continuously produce difference or sum values from two inputs that may themselves be changing quite rapidly. In the weapon system 2, the two inputs are the magazine feed rate and the demand rate of the weapon 7. As indicated above, a third output, the azimuth location of the turret 10, is treated merely as a second source or a second indication of weapon demand rate. In the gear system of the preferred embodiment, the output sprocket 31 receives weapon 7 demand rate information along a gear 37. The sprocket 31 is rotatably mounted to the plate 18 along a pair of bearings 38 and 39 respectively. The gear 37 is coupled to and transmits weapon demand to the lower transfer wheel 30 through a gear 40 interconnected to a first side of the transfer wheel 30. A second side of the transfer wheel 30 has a gear 41 attached to it. Gear 41 is coupled to a gear 42. The gear 42 in turn is connected to the differential transfer sprocket 29. As previously stated, the differential transfer sprocket 29 is mounted to the differential rounds carrier 28 which is journaled for rotation along bearing means 70 and 72 The gear 42 is coupled to a gear 43 which is mounted to a first side of the upper transfer wheel 20. A second side of the upper transfer wheel 20 has a gear 44 associated with it. The gear 44 is coupled to a gear 45. The gear 45 also is connected to the input sprocket 19 and is mechanically coupled to a magazine drive motor 76. The magazine drive motor 76 drives the gear 45, and consequently, the input sprocket 19, at a speed corresponding to the speed at which the rounds 63 leave the magazine 3.

It should be noted that the gears 40 and 41 and the gears 43 and 44 for example, may be formed in the hub structure 26 of the transfer wheels and need not be manufactured separately and attached individually to the transfer wheels. It also may be observed that because the lower housing portion 18 is rotatable about the bearing means 32 and because the output sprocket 31 is attached to the housing portion 18, gun turret 10 movement appears as a weapon demand rate signal to the reservoir 1. That is, rotation of the housing portion 18 in response to weapon 7 movement in the azimuth plane 9 causes the gear 37 to move with the housing portion 18, affecting the remaining gears in the same way as if the weapon 7 were firing ammunition rounds 63.

The function of the differential rounds carrier 28 while not complex, is probably the most difficult to understand. FIG. 3*a* is a functional flow schematic illustrating the situation where input ammunition flow is equal to output demand. In this situation, the input sprocket 19 is rotating at the output sprocket 31 speed. Consequently, there is no translation of the differential rounds carrier 28 or the transfer sprocket 29. The sprocket 29 of the differential rounds carrier 28 rotates about its axis consistent with the firing rate, but it acts as if its axis were fixed in space.

FIG. 3*b* illustrates the situation where weapon 7 demand is greater than flow. It is evident that the transfer sprocket 29 of the differential rounds carrier 28 must move to the right taking rounds from the upper transfer wheel 20 at a higher rate than they are being fed in, thereby depleting both the upper transfer wheel 20 and the lower transfer wheel 30. In the instance where flow is greater than demand, the opposite action occurs. That is, the differential rounds carrier 28 and the sprocket 29 move to the left, filling the upper and lower transfer wheels 20 and 30 respectively.

FIG. 3*c* illustrates the situation where flow from the magazine 3 is equal to weapon 7 demand but the turret 10 is moving clockwise or to the left in the diagrammatic illustration shown. Turret 10 motion in the azimuth plane 9 effects a response similar to that for a demand rate situation. The transfer sprocket 29 location moves relatively to the output sprocket 31 because the output sprocket 31 is fixed to the moving structure of lower housing portion 18. Because the output sprocket 31 moves with the turret 10, the conveyance means 14 is not required to twist to accommodate azimuth motion. Azimuth movement of the turret 10 may be viewed as the output sprocket 31 moving to meet the rounds 63 in the transfer wheels 20 and 30. Therefore, for a fixed output rate, the lower transfer wheel 30 rotation generated by turret 10 rotation causes the differential rounds carrier 28 and transfer sprocket 29 to increase the number of rounds 63 in the upper transfer wheel 20.

When the turret moves to the right, the opposite condition occurs, that is the output sprocket 31 is moving away from the rounds 63. To accommodate this apparent increase in demand, the differential rounds carrier 28 moves to the right and the transfer sprocket 29 places additional rounds in the lower transfer wheel 30. Movement of rounds 63 between the upper and lower transfer wheels 20 and 30 rounds is possible because dead space is provided in each transfer wheel for this contingency. That is, not all positions available for storage of the rounds 63 in the transfer wheels 20 and 30 are utilized in the normal operating range of the reservoir 1. Those additional spaces are available to accommodate the rounds transfer between the wheels 20 and 30 during azimuth plane 9 movement of the turret 10.

Those skilled in the art will recognize that the position of the differential rounds carrier 28 may be monitored and controlled by instrumentation not shown, affecting the drive assembly for the weapons system 2. In the event the reservoir provided by the upper and lower transfer wheels tends to overfill, the drive motor 76 for the magazine may be shut down until the transfer wheel compliment is reduced to a prescribed level. On the other hand, if the demand from the weapon 7 exceeds the flow capacity of the magazine, the reservoir provided by the transfer wheels would empty and the weapon can be shut down until the input flow partially fills the transfer wheels. In the embodiment illustrated, the total rotation of the differential rounds carrier 28 is limited to 267°. This limit is set by the input and output sprockets and the scoop cam 64. That is, the sprocket 29 of the differential rounds carrier can not pass by the input sprocket 19 or the output sprocket 31.

Additional electrical or mechanical stops or combinations of them may be utilized, if desired.

Figure 3:
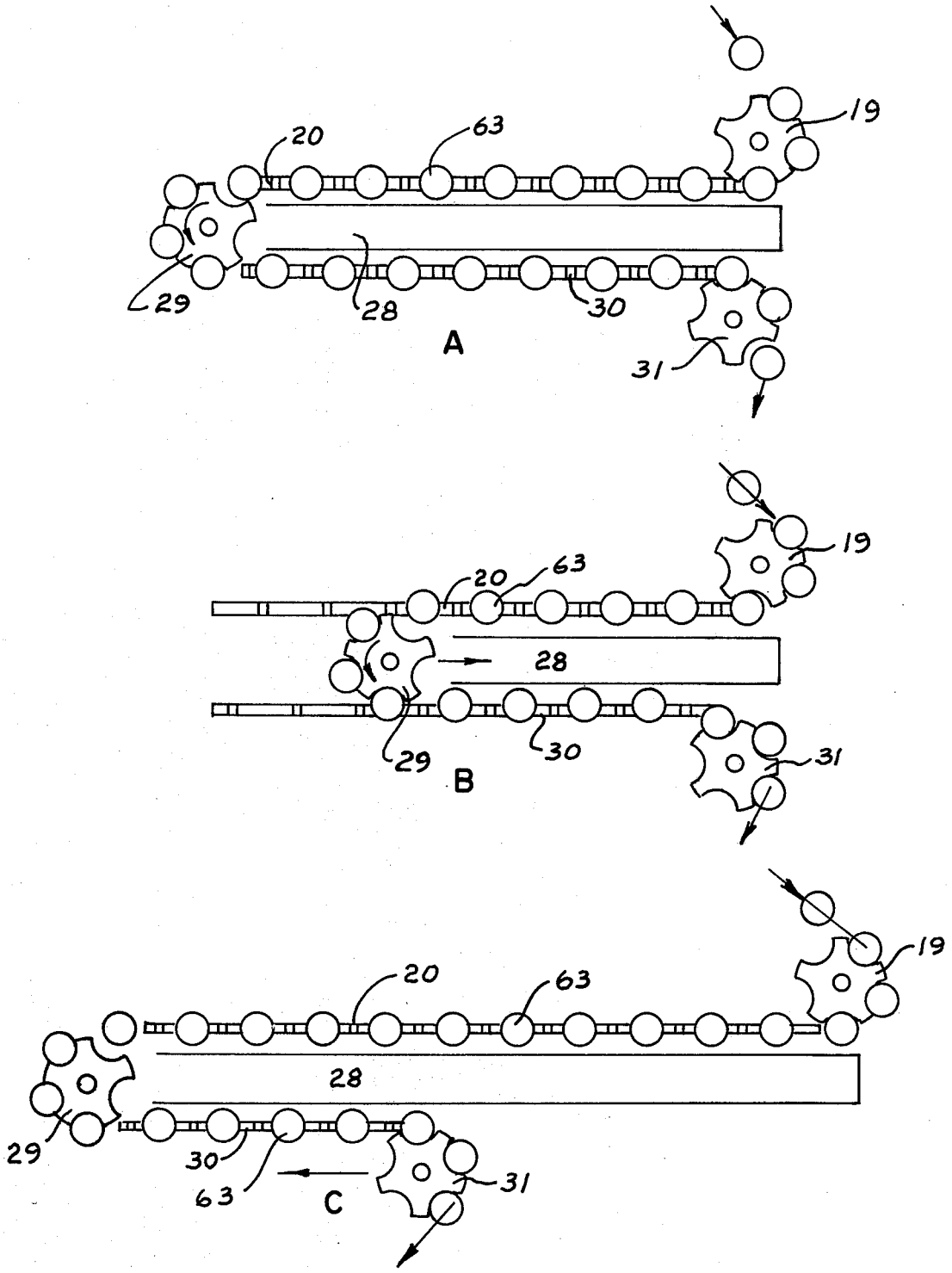
FIG. 3 is a diagrammatic view illustrating the operation of the rotary differential ammunition reservoir of FIG. 2.
Figure 4:
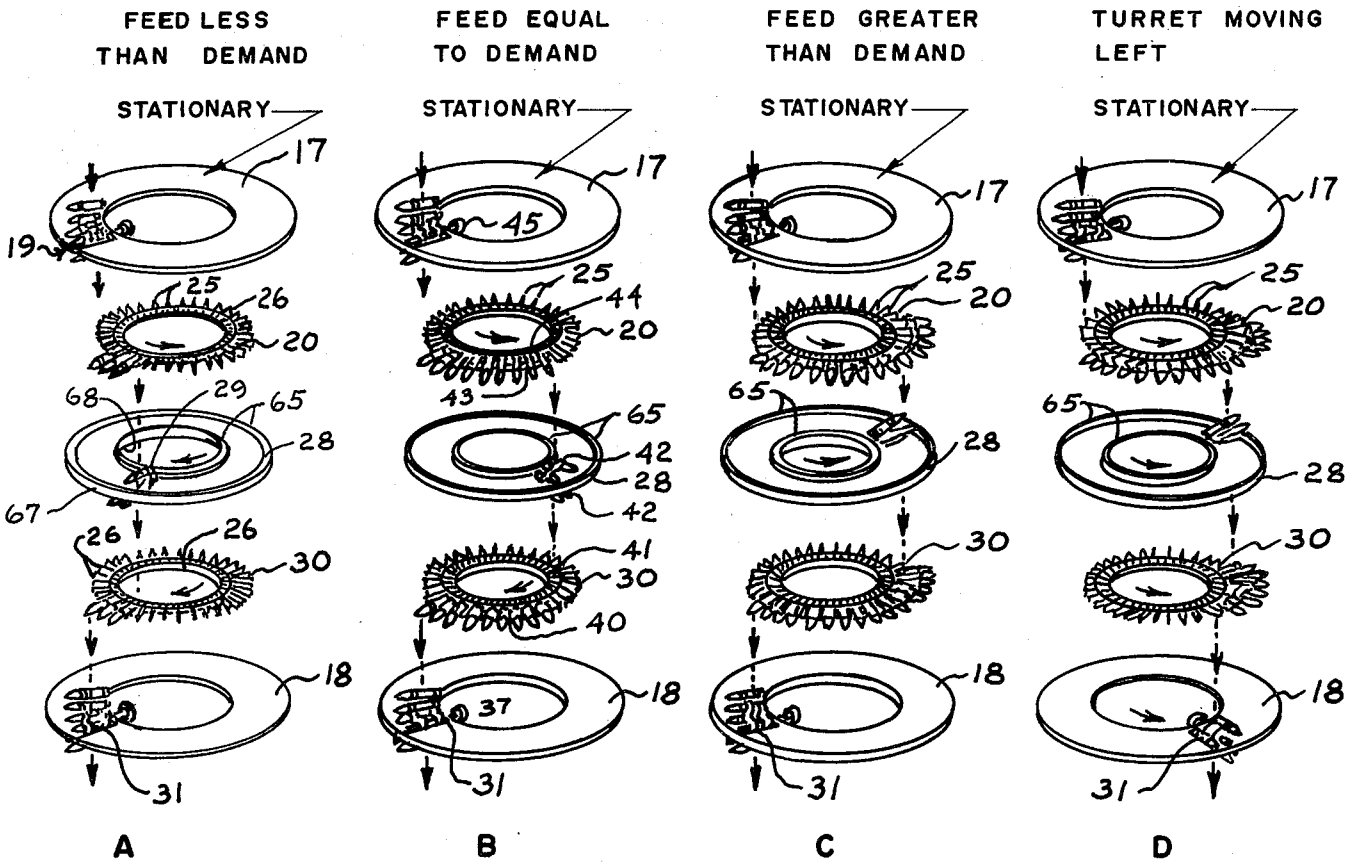
FIG. 4 is a series of exploded views correlating the diagrammatic view of FIG. 3 with the structural embodiment of FIG. 2.
Figure 5:
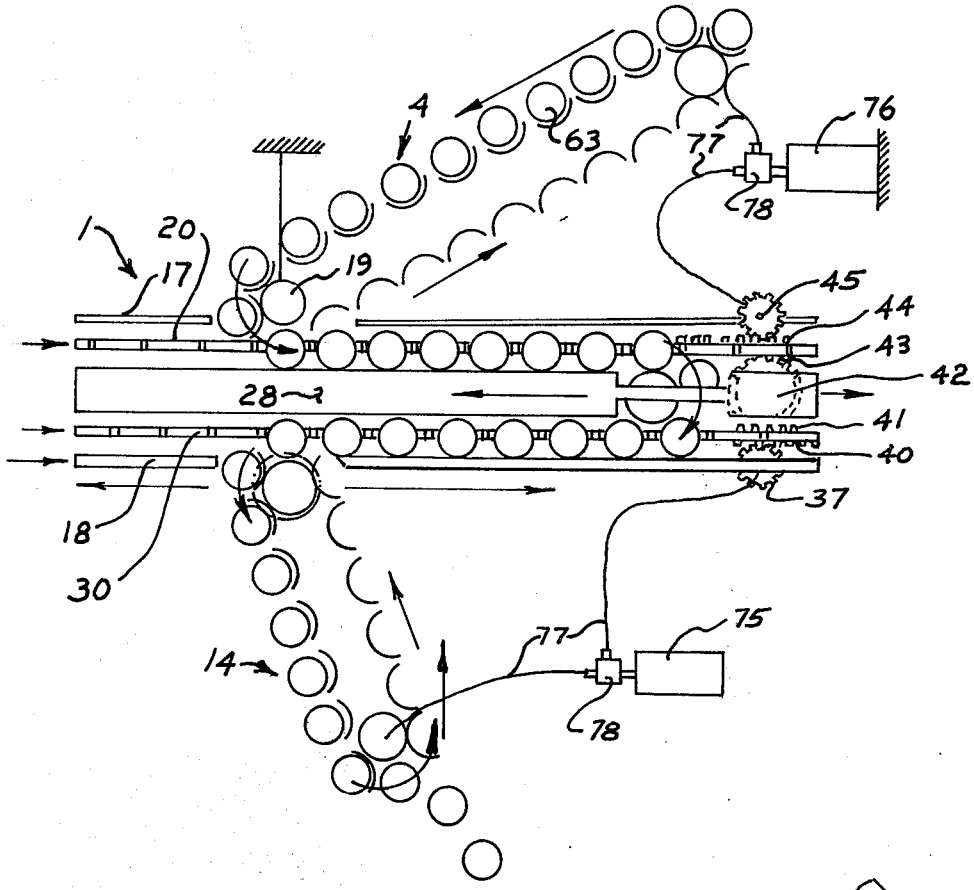
FIG. 5 is a diagrammatic view illustrating operation of the combined components of FIG. 4.
Figure 6:
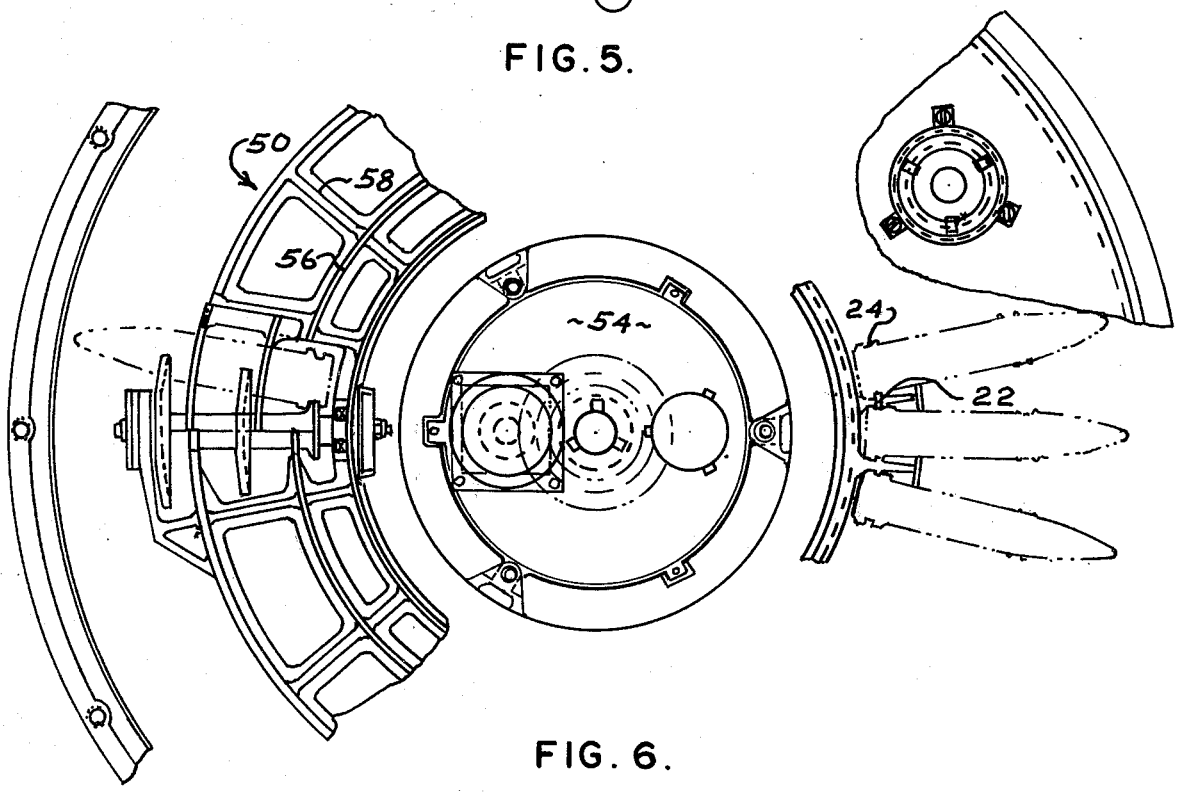
FIG. 6 is a top plan view, partly broken away, of the rotary differential ammunition reservoir shown in FIG. 2.

The operational description of the reservoir 1 made in conjunction with FIG. 3 is shown as a combination in FIG. 5 and the components of the reservoir 1 are equated in the two diagrammatic views. As previously mentioned, power to the reservoir 1 is derived from two sources, a weapon drive motor 75 and the magazine drive motor 76. Hence, the reservoir 1 acts as the balancing media. Driving torque is transmitted to the reservoir 1 via flexible shafts 77. In order to operate the shafts at high r.p.m. and low torque, a pair of drive gear boxes 78 is incorporated in the system. Low torque and flexible shafts are synonomous with smaller shafts, tighter bend radii and low wind up. The two drive gear boxes 78 are identical and are arranged in a 1 to 10 step down ratio. The ratio is achieved in a single double lead worm gear mesh. The flexible shaft input is utilized to drive the rounds 63 from the magazine 3 and to drive the gear 45. As indicated, the same drive is applied, via the gear 45, to the input sprocket 19. A similar arrangement is used between the weapons 7 drive system, the conveyance means 14 and the gear 37 on the turret 10 side of the reservoir 1.

Storage for the ammunition rounds 63 is provided by the magazine 3. Preferably, the magazine 3 is the drum type. Conventionally, this type of magazine has a fixed outer drum which incorporates a single helical track. The magazine motor 76, located at the drum, powers the inner drum whose drive staves push the rounds along the outer drum helix, out of the magazine and into the closed loop conveyance means 4 which runs between the magazine 3 and the stationary housing part 17 of the reservoir 1, located above the turret 10. Rounds are next transferred from the conveyance means 4 into the upper transfer wheel 20 of the reservoir 1 which is powered at the same rate by the magazine drive motor via the gear 45, gear 44 arrangement.

Round transfer proceeds to the lower transfer wheel 30 of the reservoir 1 and then into a closed loop conveyance means 14 running between the bottom of the reservoir 1 and the weapon 7. The weapon drive motor 75 provides weapon and feeder action as well as driving the lower portion of the reservoir 1.

The mechanical differential principle of the reservoir 1 automatically provides for major compensation between gun demand and magazine 3 feed rate during weapon firing, acceleration and shut down. The differential rounds carrier 28 senses the transient deviations between the rotation speed of the upper transfer wheel 20 of the reservoir 1 as established by feed speed of the magazine 3 and the speed of the lower transfer wheel 30 as determined by firing rate demand. The differential rounds carrier 28 seeks an azimuthal position proportional to the upper and lower transfer wheel speed difference and transfers rounds from the upper transfer wheel 20 to the lower transfer wheel 30 and hence to the weapon 7 at the proportional speed point. In effect, the reservoir 1 compliment of rounds is depleted or added to as required to accommodate firing start up or termination.

The relatively large reservoir 1 capacity provided by the upper and lower transfer wheels minimizes magazine loop control requirements. A simple control loop employing sensing switches in the reservoir 1 may be utilized to provide a trimming and safety control function. For example, those skilled in the art will recognize that control loops are known which will shut down and restart the magazine drive motor 76 in the event that the reservoir 1 capacity or depletion limits are reached, as when caused by magazine or conveyor loop failure, for example.

The reservoir 1, in addition to providing both a means of reducing system power and one plane conveyor chute motion, localizes system damage in the event of either a weapon 7 or magazine 3 jam. Should either weapon or magazine malfunction, the differential rounds carrier 28 in the reservoir 1 will be driven out of its normal operating zone, as may be sensed by potentiometer limits, for example, and will shut down either the gun drive 75 or the magazine drive 76. An additional full or empty limit sensor may be used to sense any additional travel of the differential rounds carrier 28 which can be programmed to shut off all power to the system 2. In the event of a double failure, mechanical stops may be utilized to halt differential round carrier movement.

Numerous variations, within the scope of the appended claims, will be apparent to those skilled in the art in light of the foregoing description and accompanying drawings. For example, the silhouette of the reservoir 1 may be varied in other embodiments of this invention. As indicated, the lower housing portion 18 may have a combined function of forming a portion of a gun turret enclosure. Likewise, while it is advantageous to attach the reservoir 1 to the gun turret 10, many of the desirable features of the invention may be obtained even where the reservoir 1 is positioned remote from the weapon 7 or its associated gun turret 10. The reservoir 1 may be mounted adjacent the magazine, for example. Similarly, while the weapon system 2 was described as utilizing a movable rapid fire weapon and weapon mount, either or both may be fixed. The ability to match input with output rates for a weapon system occurs even with a fixed weapon installation. The rounds 63 may be linked or linkless ammunition of various calibers. The diameter of the transfer wheels may vary in other embodiments of this invention. In like manner, the design of the feed and transfer sprockets may be changed. These variations are merely illustrative.

Having thus described the invention, what is claimed and desired to be secured by letters patent is:

1. In an ammunition transfer system for transferring ammunition from a magazine to a firing weapon, the improvement which comprises intermediate storage means for storing a number of rounds of ammunition, said number being substantially less than the number of rounds storable in said magazine, said storing means including a housing having a first upper stationary part and a second part rotatable with respect to said upper stationary part, said intermediate storage means including means for feeding the rounds into said intermediate storage means from said magazine at a first rate, means for feeding rounds to said firing weapon from said intermediate storage means at a second rate, and means for correlating said input and said output rates, said firing weapon feeding means being mounted to the second rotatable part of said housing, at upper transfer wheel having means for receiving a plurality of rounds formed in it, said upper transfer wheel receiving means being rotatably mounted to said housing, a lower transfer wheel having means for receiving a plurality of rounds formed in it, said lower transfer wheel receiving means being rotatably mounted to said housing, and differential means mounted for rotation to said housing, said differential means being positioned intermediate said upper and said lower transfer wheels and being operatively connected thereto, said differential means including means for transferring rounds from said upper transfer wheel to said lower transfer wheel, and means for allowing said differential means to seek an azimuthal position proportional to the speed of rotation of said upper transfer wheel and said lower transfer wheel.

2. The improvement of claim 1 further characterized by carrier means for transporting individual ones of said ammunition rounds, said carrier means being interconnected between said intermediate storage means and said magazine, said carrier means including an ammunition chute, said chute having a substantially constant length during operation of said ammunition transfer system.

3. In a weapon system including a magazine for storing a quantity of ammunition rounds and dispensing said rounds at a first rate, carrier means for transferring said ammunition rounds from said magazine to a weapon for firing said rounds, and a weapon capable of firing said ammunition rounds at a second rate, the improvement which comprises means for correlating said first and second rates, said correlating means including a housing having a first fixed part for interconnecting said carrier means to said correlating means and a rotating part rotatable with respect to said first part, said rotating part being movable with said weapon in an azimuth plane, said correlating means including means for feeding rounds into said intermediate storage means from said carrier means, said feeding means being mounted to said first housing part and operating at a first rate, means for feeding said rounds from said intermediate storage means to said weapon at a second rate, said second rate feeding means being mounted to said rotating housing part, a first transfer wheel rotatably mounted to said housing and drivable at said first rate, a second transfer wheel rotatably mounted to said housing and drivable at said second rate, each of said first and said second transfer wheels comprising an annular structure including a hub having a plurality of fingers extending radially outwardly therefrom, said fingers including means for engaging individual ones of said ammunition rounds, and means for summing said first and said second feeding rates, said summing means being annular in plan and having an upper surface and a lower surface, each of said upper and lower surfaces having a pair of rims extending outwardly therefrom, and sprocket means for transferring ammunition rounds between said upper and lower transfer wheels, said rims being arranged in supportive relation to the ammunition rounds carried by said upper and lower transfer wheels and being adapted to cant said rounds as said rounds approach said sprocket means, said summing means being rotatably mounted to said housing between said first and said second transfer wheels and being drivable thereby.

4. A weapons system comprising:

a magazine for storing a plurality of ammunition rounds, said magazine including means for feeding said ammunition rounds from said magazine at a first rate;

first means for carrying the ammunition rounds from said magazine operatively connected to said magazine at a first end of said carrying means, said first carrying means comprising an ammunition conveyor, and a chute, said chute enclosing said conveyor; said chute and said conveyor being substantially fixed in length;

a weapon capable of firing the ammunition rounds at a second rate, said weapon being movable in an azimuth plane and in an elevation plane;

means for correlating said first rate and said second rate, said correlating means including a housing having a movable part and a stationary part, said stationary part being operatively connected to a first end of said first carrying means and including means for receiving the ammunition rounds from said magazine, said movable part being operatively connected to and movable with said weapon in said azimuth plane, said movable part including means for feeding the ammunition rounds from said correlating means, said correlating means including a first transfer wheel for storing a predetermined number of ammunition rounds rotatably mounted to said housing, said first transfer wheel being drivable at said first rate, a second transfer wheel for storing a predetermined number of ammunition rounds mounted to said housing, said second transfer wheel being drivable at said second rate, and differential means operatively connected between said first and said second transfer wheels and drivable thereby, said differential means including means for transferring ammunition rounds from said first transfer wheel to said second transfer wheel, said first and said second transfer wheels comprising annular structures including a hub portion having a plurality of fingers extending radially outwardly therefrom, said fingers including means for engaging individual ones of said ammunition rounds, said differential means comprising an annular structure having an upper surface and a lower surface, each of said upper and said lower surfaces having a pair of rims extending outwardly therefrom; and second means for carrying the ammunition rounds from said correlating means to said weapon operatively connected between said movable part of said correlating means and an input side of said weapon, said second carrying means comprising a conveyor and a chute, said chute enclosing said conveyor, said chute and said conveyor being movable in the elevation plane with said weapon.

5. The weapon system of claim 4 wherein said differential means includes a transfer sprocket for transferring said ammunition rounds from said first transfer wheel to said second transfer wheel, said rims being positioned with respect to said transfer sprocket so as to cant said ammunition rounds as individual ones of said ammunition rounds approach said transfer wheel.

6. A device for correlating the output rate of an ammunition magazine with the input rate of a rapid fire weapon, comprising:

a housing, said housing including an enclosure having a first stationary part and a second movable part joined to one another to define a chamber therebetween;

means for injecting individual rounds of ammunition into said chamber at the output rate of said magazine mounted to said stationary part;

first means for storing a number of rounds in said chamber rotatably mounted to said housing, said first storage means being rotatably driven at the output rate of said magazine;

second means for storing a number of ammunition rounds in said chamber rotatably mounted to said housing, said second storage means being rotatably driven at the input rate of said weapon;

means for ejecting individual rounds of ammunition from said device at the input rate of said weapon; and differential means interposed between said first and said second storing means in said chamber for correlating said input rate with said output rate, said differential means including means for transferring rounds between said first and said second storage means at a point proportional to said input and said output rates, said transferring means being operatively connected between and driven by said first and said second storing means.

7. The device of claim 6 wherein said first and said second storing means comprises an annular member including a hub having a plurality of fingers extending radially outwardly therefrom, said fingers including means for engaging individual ones of said ammunition rounds.

8. The device of claim 7 wherein said stationary housing part includes a top wall, said top wall being defined by a lattice structure having a plurality of openings through it, said openings permitting observation of the chamber defined by said housing.

9. The device of claim 8 further characterized by means for canting individual rounds as said rounds approach the transferring means of said differential means.

10. A weapon system comprising:

a magazine for storing a plurality of ammunition rounds, said magazine having an output side for dispensing said rounds at a first rate;

first means for carrying the ammunition round output of said magazine, said first carrying means having a first end and a second end, said first end being operatively connected to said magazine output side;

a weapon capable of firing said ammunition rounds at a second rate, said weapon including a round input portion, said weapon being movable in an azimuth plane and in an elevation plane;

means for providing ammunition output drive from said magazine at said first rate operatively connected to said magazine;

means for providing an ammunition input drive to said weapon at said second rate operatively connected to said weapon;

means for correlating said first and said second rates, said correlating means including a housing having a movable part and a stationary part interconnected so as to define a chamber, said stationary part being operatively connected to the second end of said first conveying means, said movable part being adapted to move with said weapon in said azimuth plane, first means for storing a plurality of ammunition rounds movably mounted in said chamber, said first storing means being rotatably driven at said first rate, second means for storing a plurality of ammunition rounds movably mounted in said chamber, said second storage means being rotatably driven at said second rate, and differential means interposed between said first and said second storing means, said differential means including means for transferring rounds between said first and said second storage means, said transferring means being operatively connected between and driven by said first and said second storage means; and second means for carrying the ammunition round output of said magazine, said second carrying means being operatively connected between a movable part of said correlating means and the round input portion of said weapon.

11. In a weapons system including a magazine for storing a quantity of ammunition rounds, said magazine having an ammunition output rate, a firing weapon, said weapon being an ammunition firing rate, and an ammunition carrying system for transferring ammunition from said magazine to said firing weapon, the improvement which comprises intermediate means for correlating said output rate with said firing rate interposed in said carrier system between said weapon and said magazine, said correlating means including an enclosure defining a chamber, first storage means for storing a number of ammunition rounds mounted in said enclosure, second storage means for storing a number of ammunition rounds mounted in said enclosure, means for rotatably driving said first storage means at the output rate of said magazine, means for rotatably driving said second storage means at the firing rate of said weapon, and means for transferring rounds between said first and said second storage means at a point proportional to said magazine output rate and said weapon firing rate, said transferring means being operatively connected between and driven by said first and said second storage means.

12. The improvement of claim 11 wherein said correlating means includes a housing having a first stationary part, a second rotatable part intermountable with said stationary part to define said chamber, input means for feeding rounds into said intermediate storage means from said magazine at said magazine output rate mounted to said stationary part, and means for feeding rounds to said weapon from said intermediate storage means at said weapon firing rate mounted to said rotatable part.

13. The improvement of claim 12 wherein said first and said second storage means are annular in plan and are rotatably mounted in the chamber defined by said housing, individual ones of said storage means including a hub portion having a plurality of fingers extending radially outwardly from it, said fingers including means for engaging individual ones of said ammunition rounds.

14. The improvement of claim 13 wherein said transferring means comprises a differential operatively connected between said first and said second storage means, said differential including means for transferring rounds between said first and said second storage means.

15. The improvement of claim 14 wherein said carrier system is characterized by a substantially fixed length conveyor connected between said stationary housing part and said magazine.

16. The improvement of claim 15 wherein said firing weapon is mounted in a gun turret, said correlating means being mounted adjacent said turret.

17. The improvement of claim 16 wherein said rotatably mounted part comprises a portion of said gun turret.

18. In an ammunition transfer system for transferring ammunition from a storage area to a firing weapon, the improvement comprising intermediate storage means for storing a number of rounds of ammunition, said storing means including a housing defining a chamber, said housing having ingress and egress openings in it communicating with said chamber, means for feeding ammunition rounds into said chamber at said ingress opening, said ingress feeding means operating at a first rate, means for feeding rounds to said firing weapon at said egress opening, said egress feeding means operating at a second rate, and means for summing said input and said output rates, said summing means comprising a first transfer wheel rotatably mounted in said chamber and adapted to receive and store a predetermined number of ammunition rounds, said first transfer wheel being rotatably driven at said first rate, a second transfer wheel rotatably mounted in said chamber and adapted to receive and store a predetermined number of ammunition rounds, said second transfer wheel being rotatably driven at said second rate, and differential means mounted for rotation in said chamber, said differential means being positioned intermediate said first and said second transfer wheels and being operatively connected thereto, said differential means including means for transferring rounds between said first and said second transfer wheel, and means for allowing said differential means to seek an azimuthal position proportional to the speed of rotation of said first and said second transfer wheels during ammunition round transfer therebetween.

* * * * *

UNITED STATES PATENT AND TRADEMARK OFFICE

CERTIFICATE OF CORRECTION

PATENT NO. : 3,974,738

DATED : August 17, 1976

INVENTOR(S) : Elwyn A. Meyer

It is certified that error appears in the above-identified patent and that said Letters Patent are hereby corrected as shown below:

Column 2, line 21, "ammunization" should be ---ammunition---.

Column 3, line 16, "provice" should be ---provide---.

Column 4, line 50, "weapon 17" should be ---weapon 7---.

Column 6, line 5, "cute" should be ---chute---.

Column 7, line 31, "wth" should be ---with---.

Column 7, line 58, "72 The" should be ---72. The---

Column 14, line 36, "being" should be ---having---.

Signed and Sealed this

Fourteenth Day of December 1976

[SEAL]

*Attest:*

RUTH C. MASON
*Attesting Officer*

C. MARSHALL DANN
*Commissioner of Patents and Trademarks*